US005372150A

United States Patent [19]

Hughes

[11] Patent Number: 5,372,150

[45] Date of Patent: Dec. 13, 1994

[54] METHOD OF HARDENING AND STRENGTHENING FINGERNAILS

[76] Inventor: Sarah E. Hughes, 307 Sumner Rd., Fayetteville, Ga. 30214

[21] Appl. No.: 772,771

[22] Filed: Oct. 7, 1991

[51] Int. Cl.[5] ..... A45D 24/00

[52] U.S. Cl. ..... 132/200; 132/73; 128/898

[58] Field of Search ..... 132/73, 200; 128/898

[56] References Cited

U.S. PATENT DOCUMENTS

| | | | |
|---|---|---|---|
| 2,935,988 | 5/1960 | Floyd | 132/73 |
| 4,587,983 | 5/1986 | Wissman et al. | 132/73 |
| 4,683,897 | 8/1987 | McBride | 132/73 |
| 4,770,195 | 9/1988 | Dore | 132/73 |
| 4,954,190 | 9/1990 | Taeckens | 132/73 |
| 5,060,678 | 10/1991 | Bauman et al. | 132/200 |

*Primary Examiner*—Gene Mancene
*Assistant Examiner*—Frank A. LaViola

[57] ABSTRACT

A method which can be done in a procedure of separating a small area of nail bed flesh from the nail plate's underside, where the nail plate and nail bed join, at the forefront, to an extent back toward the base of the fingernail. A visible convex line (10), across the top of the nail plate, visible due to the translucency of the nail plate, where the nail plate and nail bed join, indicates the precise location of the forefront of the nail bed, thus of the nail bed flesh. A second and identical line, simulated convex line (12), just below and adjacent to line (10), on the nail plate (20), indicates the extent to which the nail bed flesh is separated. An intermediate area (18), formed in a concavo-convex shape, between the two identical convex lines, is the area of separation of nail plate and nail bed flesh; extending the full width of the nail bed, and from approximately 0.5 or 0.7 mm, up to approximately 2.0 mm longitudinally of the nail bed. The nail bed flesh is separated to an extent to be effective enough, yet not to an extent to cause adverse results of various kinds. Conversely, the nail plate may be partially removed with manipulation applied to the nail bed flesh in a similar manner, and to about the same intensity and degree as in the preferred method above.

5 Claims, 1 Drawing Sheet

METHOD OF HARDENING AND STRENGTHENING FINGERNAILS

BACKGROUND

1. Field of the Invention

This discovery-invention is of interest to women, and relates to the cosmetic beauty of fingernails; specifically to a method by which fingernails are hardened, strengthened and thickened, enabling them to reach a desirable length of growth.

2. Description of Prior Art

Heretofore, dermatologists, general physicians, and companies that manufacture nail products, have maintained that there is no known way of stimulating the growth of fingernails, or of hardening and strengthening nails to promote growth.

In applicant's search and research, however, she has found that recently, in treating yeast infections spread through manicures, dermatologists have been testing new medications in polish form and conducting studies with minoxodil, an FDA-approved drug, which has been used to stimulate hair growth. Because fingernails and hair have similar structure, doctors believe minoxodil may stimulate nail growth also.

There are a series of products called nail hardeners which dermatologists generally do not recommend the use of. Some authors of health and beauty aid books do recommend the use of these nail hardeners while others don't.

Nail hardeners are applied like nail enamel and temporarily make nails more resistant to chipping and breaking. Many of these products contain formaldehyde, which may cause severe allergic reactions, such as bluish discoloration of the nails to painful scarring and cracking of the nail and cuticle, to severe bleeding in the nail bed, to loosening, or even the loss of a nail.

Other nail hardeners, which are safer to use, such as nylon fiber hardeners, are less effective than formaldehyde hardeners.

Artificial nails of various types are applied in nail and beauty salons. The press-on type are a simple, safe, instant manicure, but lasts only a few hours. Nail tips and sculptured artificial nails, acrylics, gel nails and linen or silk wraps are glued to the nail and can last for weeks with occasional touch-ups. Fungus and mold can grow between the fake nail or wrap, and the nail bed, going undetected for weeks, and can cause the natural nail to separate from the nail bed. The adhesives used for these can also cause allergic reactions.

Finally, probably most relevant to applicant's invention is that it is known that women who type, play piano, and do heavy work with their hands, are often women who have the strongest nails and have some growth. When they let up on the work, it is said that their nails often become softer; and also women who are, or have been, nail biters during childhood or adolescence.

Despite that the above has been observed over time, it has nevertheless eluded those closest to this field; dermatologists, general physicians, nail specialists of various universities, manicurists and others, how nails are hardened and strengthened or how growth is stimulated.

Mary Ann Crenshaw, author of The Natural Way to Super Beauty, recommends buffing the nails and good nutrician, specifically suggesting protein foods, and B vitimins; though dermatologists contend that nutrician is of no special value to nails. Other authors of health and beauty aid books recommend retaining moisture in nails lavishly, just as one would in the skin; using nail polish removers as little as possible; and to avoid nail hardeners, artificial nails and nail wraps.

Current magazine articles on nail care have many of the same or similar suggestions.

OBJECTS AND ADVANTAGES

Accordingly, several objects and advantages of applicant's invention are:

(a) to provide a means of enabling women to enjoy the growth of their nails as opposed to soft, peeling, and breaking nails;

(b) to provide a dependable, sure, and reliable means of promptly hardening, strengthening, and thickening fingernails.

(c) to provide, alternatively, a means of enabling women to enjoy the growth of their own natural nails, as opposed to wearing artificial nails or needing nail wrappings for weak, breaking nails:

(d) to obviate the need for artificial nails and the use of nail wraps or nail hardeners; further eliminating the fungas infections and allergic reactions caused by artificial nails, nail wrappings, and nail hardeners.

(e) to provide a procedure which, whenever done once, may not every need to be done again.

(f) to provide a simple and safe procedure, which might be done by dermatologists and other physicians, but could as well be done in nail and beauty salons by specially trained manicurists and other specially trained personnel.

DRAWING FIGURES

The outer structure of the human fingernail is shown in FIG. 1 in an illustration of a human hand and in an enlarged illustration of a human thumb; shown in FIG. 2. These illustrations, of necessity, show and include the nail plate, which covers the entire area of the nail bed. Broken lines indicate the nail bed area.

FIGS. 1 and 2 show an identical "simulated" convex shaped line, located just below the first convex shaped line, indicating the point to which the nail bed flesh is separated from the nail plate.

FIGS. 1 and 2 show an intermediate area near the top of the nail plate, shown between the two identical lines, being the area of separation.

Figure 1:
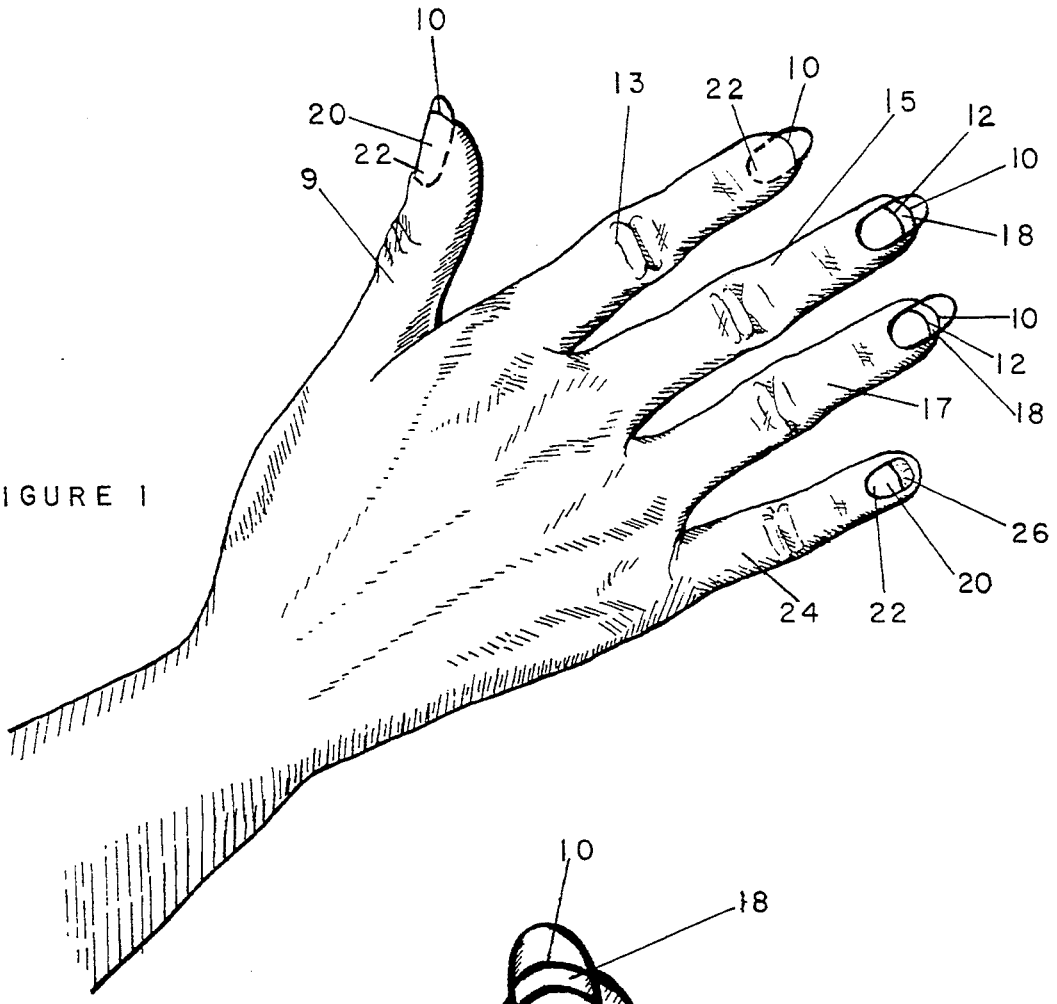
FIGS. 1 and 2 show a visible convex shaped line, the natural "line" across and near the top of the nail plate, which is the point, and thus is shown as the point at which the nail plate and the nail bed join on the nail plate's underside.

FIG. 1 otherwise shows the thumb, the index finger, the middle and the third finger of the hand, and the little finger.

In FIG. 1, various aspects of the preferred method are more clearly shown on one finger as opposed to another.

Figure 2:
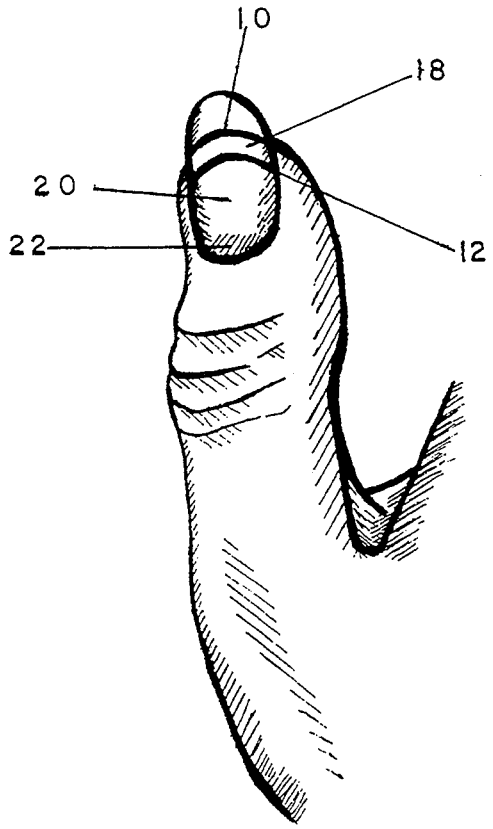

Other than the above, FIG. 2 also shows the nail plate and the base of the nail.

FIG. 1 also shows the method done conversely on the little finger, with broken lines indicating the nail bed, on the thumb and index finger.

| Reference Numerals In Drawings | |
|---|---|
| 9 thumb | 10 visible convex line |
| 12 simulated convex line | 13 index finger |
| 15 middle finger | 17 third finger |
| 18 intermediate area | 20 nail plate |
| 22 base of the nail | 24 little finger |
| 26 nail bed | |

DESCRIPTION AND OPERATION

The outer structure of the human fingernail is shown in drawing FIGS. 1 and 2.

These illustrations show the nail plate 20, which covers the entire area of the nail bed. The nail plate is shown primarily because the natural visible convex "line", visible convex line 10, across the top of the nail plate 20, visible due to the translucency of the nail plate, shows and indicates the exact location of the forefront of the nail bed, being the point at which the nail plate and the nail bed join, on the nail plate's underside.

In FIG. 1, visible convex line 10 is shown most clearly on the thumb 9 and index finger 13; simulated convex line 12 being typically not shown. Visible line 10 is also shown on middle finger 15 and third finger 17, as is simulated line 12. Line 12 is shown adjacent to and just below visible line 10 on the nail plate 20, and in the direction of the base of the nail 22; both also being shown in FIG. 2.

Intermediate area 18 is therefore, being between line 10 and line 12, shown only on middle finger 15 and third finger 17 in FIG. 1; and also in FIG. 2.

In the concavo-convex shape of intermediate area 18, a frontal section or area of nail bed flesh is separated from the underside of the nail plate 20. The frontal area of nail bed flesh is separated across the full width of the nail plate, and to an extent longitudinally of the nail plate of approximately 0.7 to 2.0 mm; being separated, or as like abraded from the nail plate's underside. If done by some means of mere separation, the nail bed flesh must be sufficiently manipulated in the separated area to effect the change in the fingernail. If done by abrasion, the area of separation is, of course, manipulated.

Theoretically, whenever the nail bed flesh is separated or abraded from the nail plate's underside, the upper part of the nail bed flesh seemingly partially dies, the outermost part, and becomes thickened and hardened. The outermost part of the nail bed flesh seemingly becomes dead cells itself, like the keratin of the nail plate, attaching itself to the softer, thin nail plate, and grows in this thicker and more hardened state. In any case, manipulation to the nail bed flesh is necessary to cause its thickening and outer hardening.

Thus the fingernail, after its separation from the small area of the nail bed, remains in conformity with its original structure; having a newly situated visbile "line" where the nail bed and nail plate join on the latter's underside; being approximately 2 or so mm more deeply inset on the nail plate's underside. Within a short time, however, the nail plate and nail bed bond again with new growth, in the area of separation.

Conversely, the nail plate may be partially removed at the top of the nail, which, when being removed, would require manipulation to the exposed nail bed flesh. It is probably impossible to remove it without manipulation, unless possibly by a sophisticated new medical technique, as nail plate and nail bed flesh cling tenaciously.

In drawing FIG. 1, on little finger 24, the nail plate 20 is shown partially removed at the top or frontal area of the nail. The top area, a small section of the nail bed 26 is exposed. The nail plate is removed by its full width, as shown; and from the point at which the nail bed and the nail plate join at the forefront of the fingernail, to about 2.0 to 3.0 mm toward the base of then ail, or longitudinally.

The nail bed flesh could be seperated from the nail plate in most any fashion, effecting the same results to the nail plate; on one side of the nail bed only, however, causing crooked growth of the nail, greater than 3.0 mm longitudinally thereof; in a jagged fashion, reversed concave shape, etc. A variety of problems, however, can result, such as too great a thickness to the nail plate, vertical ridges forming on the nail, a deeper separation of then ail plate and nail bed, etc.

When the nail bed flesh is separated from the nail plate's underside by less than 0.5 mm longitudinally, there is some degree of change to the nail plate; a slight change, but applicant could not discern a significantly desirable difference from personal experimentation.

The preferred method, being the separation of the nail bed flesh from the nail plate's underside, of course, does not have to be done in the particular fashion herein described—the separation being done in a concavo-convex shape and to 2.0 mm longitudinally from the frontal area, etc., but is indeed probably the best possible way that it could be done, for at least two reasons: the uniform convex shape of the new "line" across the nail's tip, where the nail plate and nail bed join, once the procedure is done, as well as a limited extent of separation longitudinally, 2.0 mm, will deter or greatly reduce the contingency of a greater separation of the nail plate and nail bed developing or occuring while the recipient of the procedure does housework or other work; and secondly, to the extent of 2.0, mm only, renders great results.

The converse method: removing a frontal portion of then ail plate, is probably by far the better method, in that the nail plate can be partially removed in most any fashion, with virtually no adverse results or problems of any kind; however, many women likely would not prefer going through a period of time, albeit a short period, when their nails would be displeasing in appearance. The nail grows at a rate of about 0.5 to 1.0 mm per week, the healing period being possibly as long as 6 to 7 weeks. The press-on type artificial nails might be used some during this time.

Either method should be done by professional medical standards to avoid the possibility of any possible medical problems, such as infection going untreated, or possible damage to the nail bed, any possibility of nail deformation, or the loss of a nail, etc.

Thus, inasmuch as either method is done, the entirety of the nail plate hardens, thickens, and becomes considerably stronger, enabling the nail plate to grow beyond the ail bed to a desired potential of growth, enhancing an attractive and fashionable appearance of the nails.

SUMMARY, RAMIFICATIONS, AND SCOPE

Thus the reader will see that the method of the invention herein described solves a long-standing problem for women who are particular about the appearance of their nails, and who have "problem" nails; and that the procedure is safer than many of the temporary manicures done in nail and beauty salons; that it is a relatively simple procedure that causes a prompt hardening, thickening, and strengthening of the nail plate. It also uses a new principle and method of procedure, and whenever the procedure is done once, it likely will never have to be repeated.

A number of variations were detailed in the description, as well as a converse method of doing the procedure, principally to convey that the nail bed flesh can be separated from the nail plate in many different ways, effecting the same results of hardness, thickness, and strength to the nail plate. The nail bed flesh might be separated from the nail plate to a greater or lesser extent longitudinally of the nail bed, on one side of the nail bed only, down the center or each side vertically, in a reversed concave shape, in a zig-zagged manner, etc.; the nail bed flesh manipulated, torn, detached, eroded, abraded, chemically or otherwise treated to detach, or in any other conceivable way to otherwise effect separation of nail plate and nail bed will bring about the same results of hardness, thickness and strength to the nail plate, with manipulation applied to the nail bed flesh.

An alternative way of doing the procedure: removal of the nail plate with disturbance or manipulation to the nail bed flesh, described in the discussion, would facilitate a speedier healing process, the nail plate bonding back very quickly with new growth.

A number of specificities are detailed above, but these should not be construed as limiting the scope of the invention. Accordingly, the scope of the invention should be determined by the appended claims and their legal equivalents, rather than by the examples given.

I claim:

1. A method of hardening and strengthening fingernails, comprising:

separating a natural fingernail from its associated fingernail bed;

partially removing said natural fingernail from an initial point where said fingernail bed and said fingernail are joined to a second point inward, thereby exposing fingernail bed flesh, and manipulating said flesh to effect a hardening and thickening of said natural fingernail.

2. The method of claim 1 wherein said natural fingernail is removed to said second point inward of approximately 2.0–3.0 millimeters.

3. A method of hardening and strengthening fingernails comprising:

separating a natural fingernail from its associated fingernail bed by partially detaching said natural fingernail to form a detached area, said detached area being form an initial point where said fingernail bed and said fingernail are joined to a second point inward of said initial point, and manipulating flesh under said fingernail to effect a hardening and thickening of said natural fingernail.

4. The method of claim 3 wherein said natural fingernail is partially detached to said second point inward of approximately 2.0 millimeters from said initial point.

5. The method of claim 3 wherein said detached area is formed in a concavo-convex shape.

* * * * *